US005133615A

United States Patent [19]

Saito et al.

[11] Patent Number: 5,133,615

[45] Date of Patent: Jul. 28, 1992

[54] TICKET ISSUING MACHINE

[75] Inventors: Masami Saito; Sakae Shiida; Toshiaki Ohshiro, all of Shizuoka, Japan

[73] Assignee: Tokyo Electric Co., Ltd., Tokyo, Japan

[21] Appl. No.: 571,150

[22] Filed: Aug. 23, 1990

[30] Foreign Application Priority Data

| | | | |
|---|---|---|---|
| Sep. 7, 1989 | [JP] | Japan | 1-232407 |
| Sep. 7, 1989 | [JP] | Japan | 1-232408 |
| Sep. 27, 1989 | [JP] | Japan | 1-251115 |

[51] Int. Cl.[5] ..... B41J 11/26

[52] U.S. Cl. ..... 400/621; 101/227; 226/45; 226/143; 225/4; 225/106; 346/24

[58] Field of Search ..... 400/621; 101/224, 225, 101/226, 227, 228; 226/45, 143; 225/4, 32, 74, 93, 98, 101, 105, 106; 493/340, 354, 355, 369, 372; 346/24

[56] References Cited

U.S. PATENT DOCUMENTS

| | | | |
|---|---|---|---|
| 3,786,708 | 1/1974 | Mumper | 493/372 |
| 3,794,228 | 2/1974 | Colwill et al. | 225/93 |
| 3,863,821 | 2/1975 | Van Bennekom | 225/93 |
| 4,216,719 | 8/1980 | Flaceliere | 400/621 |
| 4,302,119 | 11/1981 | Siegenthaler | 400/621 |
| 4,485,949 | 12/1984 | Gebhart et al. | 226/45 |
| 4,623,081 | 11/1986 | Hain et al. | 225/105 |
| 4,688,708 | 8/1987 | Irvine et al. | 225/106 |
| 4,697,726 | 10/1987 | Gaucher | 225/106 |
| 4,723,488 | 2/1988 | Inouye et al. | 226/143 |
| 4,827,841 | 5/1989 | White | 101/66 |
| 4,941,377 | 7/1990 | Ishihara et al. | 400/621 |

FOREIGN PATENT DOCUMENTS

| | | | |
|---|---|---|---|
| 0298248 | 5/1988 | European Pat. Off. . | |
| 3417380 | 11/1985 | Fed. Rep. of Germany | 400/621 |
| 0018755 | 2/1979 | Japan | 400/621 |
| 0131084 | 8/1983 | Japan | 400/621 |
| 0313245 | 12/1989 | Japan | 226/45 |
| 2143356 | 2/1985 | United Kingdom . | |
| 8905490 | 6/1989 | World Int. Prop. O. . | |

OTHER PUBLICATIONS

"Document Burster", IBM Technical Disclosure Bulletin, vol. 16, No. 6, Nov. 1973, pp. 1753-1754.

Soviet Inventions Illustrated, Section PQ, Week 8943, Apr. 7, 1989, Derwent Publications Ltd., London, GB; Class P74, AN 89-315081/43 & SU-A-1,470,570, (Omsk Poly), Jun. 23, 1987.

*Primary Examiner*—Eugene H. Eickholt

*Attorney, Agent, or Firm*—Oblon, Spivak, McClelland, Maier & Neustadt

[57] ABSTRACT

A ticket issuing machine having a stocker for containing a continuous form, a paper carrier device for carrying the continuous form supplied from the stocker to an inlet of a carrier line, a paper separating device for separating the continuous form at a score thereof in the carrier line, and a printing/recording device for printing or recording data on the continuous form. The paper separating device includes a blade retained so as to be movable toward and away from a score formed in the continuous form, which blade has a rounded bursting portion adapted to face the score, and a blade driving mechanism for driving the blade so as to bring the blade into abutment against the score for separation of the continuous form at the score. Accordingly, the continuous form can be reliably separated at the score with a small force.

5 Claims, 3 Drawing Sheets

TICKET ISSUING MACHINE

FIELD OF THE INVENTION AND RELATED ART STATEMENT

The present invention relates to a ticket issuing machine for issuing a ticket or the like after printing or recording necessary data thereon, and more particularly to such a ticket issuing machine using a continuous form to be separated into a plurality of tickets or the like.

A conventional ticket issuing machine for issuing a ticket or the like after printing or recording necessary data thereon is generally classified into two types. One of the types has a structure such that a plurality of blank tickets each having a predetermined size are used to be printed or recorded, while the other type has a structure such that a continuous form is used to be separated into a plurality of blank tickets which are subjected to printing or recording. In the former type using the blank tickets each having a predetermined size, it is general that a stack of the blank tickets are contained in a stocker, and they are taken out of the stocker by means of a pickup roller. However, it is necessary to provide a separating mechanism for separating the blank tickets one by one in taking the blank tickets out of the stocker. Accordingly, the structure of the machine is complicated, and if control of the separating mechanism is unsatisfactory, there is a possibility that two or more of the blank tickets will be taken out together at the same time. Under the circumstances, the other type using he continuous form without the above defect is often adopted.

Generally, such a ticket issuing machine using the continuous form includes a stocker for containing the continuous form zigzag folded along a plurality of scores formed transversely of the continuous form, a carrier line for guiding the continuous form from the stocker to a ticket issuing outlet, paper carier means for carrying the continuous form in the carrier line, a paper separtating device for separating the continuous form at the scores to form a plurality of blank tickets, and printing/recording means for printing or recording necessary data on the blank tickets to form final tickets. When the continuous form contained in the stocker is inserted into a paper inlet of the carrier line, the continuous form is fed in the carrier line to reach the paper separating device. After the continuous form is separated into the blank tickets by the paper separating device, the blank tickets are fed one by one to the printing/recording means. In the case of a boarding card issuing machine for an airplane, the blank tickets are fed to an encoder as the printing/recording means, and necessary data are magnetically recorded on the blank tickets by the encoder. Then, the recorded tickets are fed to a printer as the printing/recording means, and necessary data are printed on the recorded tickets by the printer. Thereafter, the boarding cards obtained above are issued from a card outlet formed at a terminal point of the carrier line.

Meanwhile, the paper separating device for separating the continuous form at each score is generally classified into a cutting type and a bursting type from the viewpoint of paper separation manner. In the cutting type, a cutter having a sharp cutting edge is used as a blade, and the continuous form is cut at the score by the cutter. The cutting type is further classified into a rotary cutter type and a guillotine type from the viewpoint of the cutting operation. In the rotary cutter type, the cutting edge is rotated to cut the continuous form, while in the guillotine type, a pair of cutters are used to cut the continuous form like scissors cutting. On the other hand, in the bursting type, a burster having a blunt bursting edge is used as a blade, and the continuous form is burst at the score by pressing the bursting edge of the burster against the continuous form. That is, when the burster is pressed against the continuous form, a tensile force is applied to the continuous form in opposite directions with respect to the score, with the result that the continuous form is burst at the score.

The above-mentioned prior art has the following defects. First, as to the paper separating device, the cutting type has a defect such that if the score of the continuous form is slipped from a proper cutting position of the cutter, the continuous form is cut at a position other than the score. The bursting type has a defect such that a large force is required upon separation of the continuous form because the continuous form is forcibly burst by the burster. Furthermore, if a contact position of the bursting edge of the burster on the continuous form is slipped from the score, the continuous form is dragged by the burster in its forcing direction to cause undesired bursting.

In inserting the continuous form contained in the stocker into the inlet of the carrier line, a leading end of the continuous form is manually inserted into the inlet of the carrier line under a stopped condition of the paper carrier means. However, a pair of carrier rollers to be driven by a motor are used as the paper carrier means, and the continuous form is nipped between the carrier rollers during rotation thereof. Accordingly, when setting the continuous form at the inlet portion of the carrier line, the continuous form is obliged to be inserted between the carrier rollers against a resistance of the motor which remains stopped. Moreover, in the case of drawing off the continuous form from the inlet portion of the carrier line as required, there is a possibility that the continuous form will be cut at the score if it is drawn without paying attention to a drawing position or the like of the continuous form.

OBJECT AND SUMMARY OF THE INVENTION

It is a first object of the present invention to provide a ticket issuing machine which prevents the continuous form from being burst at any portion other than the score.

It is a second object of the present invention to provide a ticket issuing machine which may separate the continuous form with a small force.

It is a third object of the present invention to provide a ticket issuing machine which eliminates undesired separation of the continuous form due to dragging of the continuous form by the burster.

It is a fourth object of the present invention to provide a ticket issuing machine which may easily set the continuous form at the inlet portion of the carrier line.

According to one aspect of the present invention, there is provided in a ticket issuing machine having a stocker for containing a continuous form, paper carrier means for carrying the continuous form supplied from the stocker to an inlet of a carrier line, paper separating means for separating the continuous form at a score thereof in the carrier line, and printing/recording means for printing or recording data on the continuous form; the improvement wherein said paper separating means comprises a blade retained so as to be movable toward and away from a score formed in said continuous form, said blade having a rounded bursting portion adapted to face said score, and blade driving means for driving said blade so as to bring said blade into abutment against said score for separation of said continuous form at said score.

In the above feature of the present invention, the roundness of the bursting portion of the blade means that the bursting portion is round as viewed in a direction parallel to the score of the continuous form. When the blade is driven by the blade driving means to come into abutment against the score, the bursting portion of the blade is pressed against the score to burst the continuous form at the score. In the bursting operation, since the bursting portion of the blade is round, a contact resistance between the blade and the continuous form may be reduced to make it possible that the continuous form is separated with a small force. Furthermore, even when the blade is brought into abutment against any portion of the continuous form other than the score, there is no possibility of the continuous form being separated at this portion since the bursting portion of the blade is not a sharp cutting edge.

According to another aspect of the present invention, the bursting portion of the blade has a shape such that opposite side edges or one side edge of the bursting portion may come into contact with the continuous form earlier than a central portion of the bursting portion. In this feature, the opposite side edges or one side edge and the central portion of the bursting portion are intended to be defined as viewed in a direction perpendicular to the score.

With this construction, a contact position of the blade on the continuous form is moved along the score from its weakest opposite ends or one end to the central portion upon separation of the continuous form. Accordingly, the continuous form may be separated with a smaller force.

According to a further aspect of the present invention, the ticket issuing machine further comprises a plurality of carrier rollers provided just upstream and downstream of said paper separating means for nipping and feeding said continuous form; and paper fixing means for stopping rotation of said carrier rollers and fixing said continuous form upon separation of said continuous form or for applying a torque to said carrier rollers in opposite directions such that a tension is applied to said continuous form upon separation of said continuous form.

With this construction, the continuous form may be reliably separated at the score which is the weakest portion of the continuous form without dragging of the continuous form by the blade in its forcing direction.

According to a still further aspect of the present invention, the ticket issuing machine further comprises paper feeding means provided in the vicinity of said inlet of said carrier line for feeding said continuous form in forward and reverse directions; a start sensor provided upstream of said paper feeding means in said carrier line for detecting whether or not said continuous form is present in said carrier line; a stop sensor provided downstream of said paper feeding means in said carrier line for detecting whether or not said continuous form is present in said carrier line; and paper feed control means for generating a paper feed start signal to said paper feeding means according to a detection signal output from said start sensor and also generating a paper feed stop signal to said paper feeding means according to a detection signal output from said stop sensor, thus effecting automatic forward feeding of said continuous form, while for generating a paper reverse feed signal to said paper feeding means to effect automatic reverse feeding of said continuous form.

With this construction, when the continuous form is inserted into the inlet of the carrier line, a leading end of the continuous form is detected by the start sensor, and a detection signal form the start sensor is input into the paper feed control means. Then, the paper feed control means generates a paper feed start signal to the paper feeding means. As a result, the paper feeding means operates to forwardly feed the continuous form. Thereafter, when the leading end of the continuous form is detected by the stop sensor, a detection signal from the stop sensor is input into the paper feed paper feed stop signal to the paper feeding means. As a result, the paper feeding means operates to stop the forward feed of the continuous form. Thus, the automatic setting of the continuous form is carried out. On the other hand, when the continuous form in the carrier line is intended to be reversely fed to be returned to the stocker, the paper feed control means generates a paper reverse feed signal to the paper feeding means. As a result, the paper feeding means operates to reversely feed the continuous form, thus carrying out automatic reverse feeding of the continuous form.

DETAILED DESCRIPTION OF THE PREFERRED EMBODIMENTS

Figure 1:
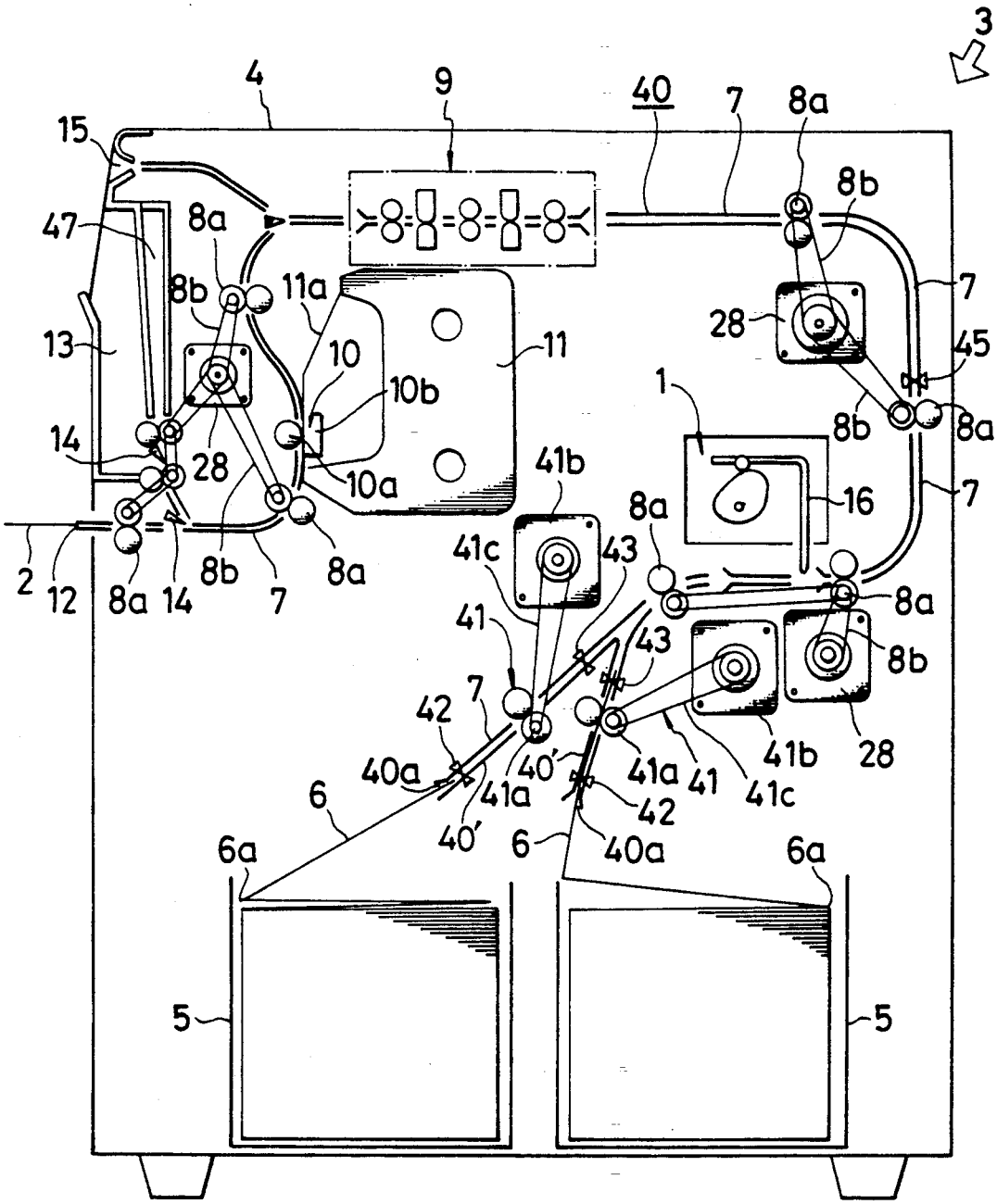
FIG. 1 is a side view of an internal structure of the ticket issuing machine according to a preferred embodiment of the present invention.

There will now be described a preferred embodiment of the present invention with reference to FIGS. 1 to 5. This preferred embodiment is applied to a boarding card issuing machine 3 for issuing a boarding card 2 as a ticket for an airplane.

Two stockers 5 are provided in a case 4 for the issuing machine 3 as placed on a bottom surface thereof, and a continuous form 6 folded zigzag along its scores 6*a* is contained in each stocker 5. There are provided in the case 4 a plurality of guide plates 7 defining a predetermined carrier line 40 for carrying the continuous form 6 and a plurality of carrier rollers 8*a* each located between the adjacent guide plates 7. The carrier line 40 is forked at its upstream end portion to form a pair of branch portions 40' having two paper inlets 40*a* directed to the two stockers 5, respectively. Each of the carrier rollers 8*a* is constructed of a pair of rollers designed to nip the continuous form 6 therebetween and be rotated in counter directions to feed the continuous form 6. More specifically, a plurality of driving motors 28 are provided to drive the carrier rollers 8*a*, and a driving belt 8*b* is provided to connect the driving motor 28 with one of the pair of rollers constituting each carrier roller 8a. Thus, the carrier rollers 8a, the driving motors 28 and the driving belts 8b constitute paper carrier means according to the present invention.

Figure 2:
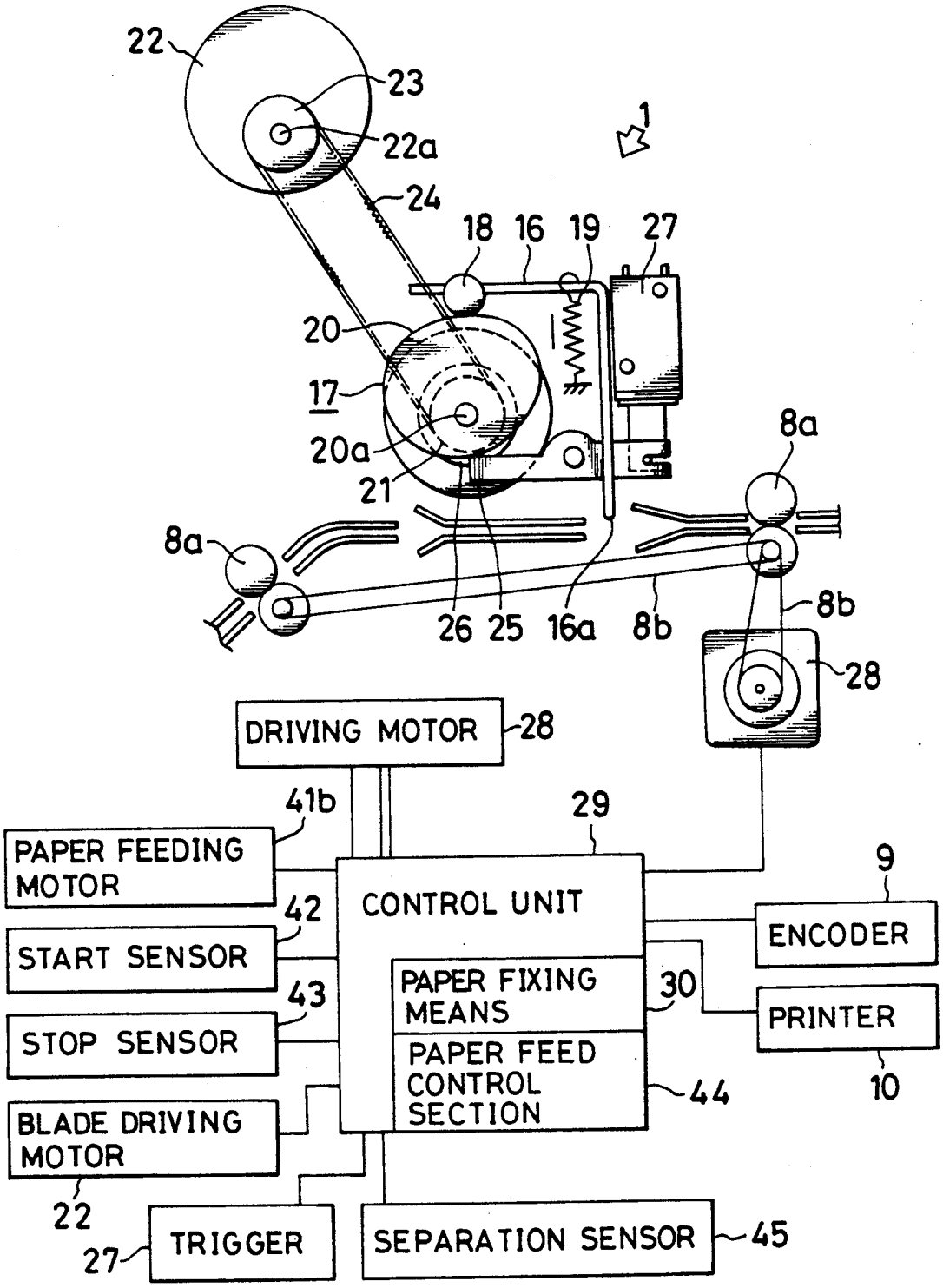
FIG. 2 is an enlarged side view of the paper separating means shown in FIG. 1 in connection with a schematic block diagram of a control circuit.

As shown in FIG. 2, a control unit 29 for controlling a general electric system of the machine 3, and the driving motors 28 are electrically connected to the control unit 29.

Referring back to FIG. 1, there are provided in connection with the carrier line 40 a pair of paper feeding means 41, a paper separating means 1 and a printing-/recording means constituted of an encoder 9 and a printer 10. These means are arranged from the upstream end portion to the downstream end portion of the carrier line 40.

Each of the paper feeding means 41 is located in connection with the corresponding branch portion 40' of the carrier line 40. The paper feeding means 41 is constituted of a pair of paper feeding rollers 41a for feeding the continuous form 6 by nipping the same therebetween and rotating in counter directions, a paper feeding motor 41b rotatable in forward and reverse directions, and a driving belt 41c for connecting the motor 41b with one of the paper feeding rollers 41a. A start sensor 42 and a stop sensor 43 are located in each branch portion 40' of the carrier line 40 at positions upstream and downstream of the paper feeding rollers 41a, respectively, so as to detect whether or not the continuous form 6 is present in the branch portion 40' of the carrier line 40. As shown in FIG. 2, all of the paper feeding motors 40b, the start sensors 42 and the stop sensors 43 are electrically connected to a paper feed control means 44 in the control unit 29. The paper feed control means 44 controls the operation of the paper feeding means 41 according to output signals from the start sensors 42 and the stop sensors 43.

Figure 3:
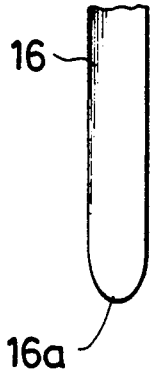
FIG. 3 is a side view of the bursting portion of the blade in the paper separating means.
Figure 4:
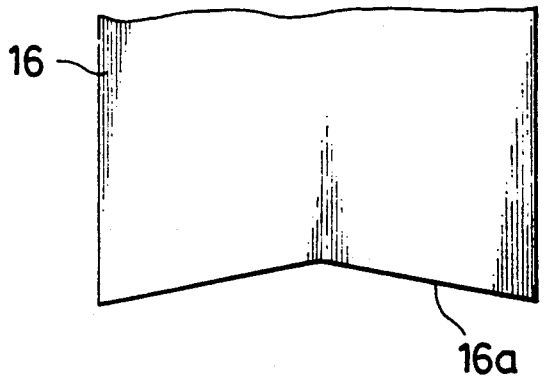
FIG. 4 is a front elevation of FIG. 4.

Now, the paper separating means 1 will be described with reference to FIGS. 2 to 4. The paper separating means 1 is located in connection with the carrier line 40 at a position just downstream of a joining point of the two branch portions 40' of the carrier line 40. The paper separating means 1 is constituted of a blade 16, a blade driving means 17 for driving the blade 16, and a separation sensor 45 for detecting whether or not the continuous form 6 is present in the carrier line 40. The blade is formed by bending a plate-like member at an intermediate thereof at a right angle. A contact member 18 is mounted to one end of the blade 16, and a bursting portion 16a is formed at the other end of the blade 16. As shown in FIG. 3, the bursting portion 16a is round as viewed in side elevation, and as shown in FIG. 4, it is recessed like an inverted V-shape so as to be inclined downwardly from its central portion to the opposite side edges as viewed in front elevation. The blade 16 is retained in such manner that the bursting portion 16a is opposed to the continuous form 6 and can retractably abut against the continuous form 6 in a direction perpendicular thereto. A spring 19 is connected to the blade 16 to apply a biasing force toward the continuous form 6. The blade driving means 17 is constructed in the following manner. That is, a cam 20 is provided at a position where it contacts the contact member 18, and a transmitting gear 21 is mounted on a cam shaft 20a of the cam 20. A blade driving motor 22 is provided to apply a driving force to the blade 16, and a driving gear 23 is mounted on a driving shaft 22a of the blade driving motor 22. A timing belt 24 is wrapped around the driving gear 23 and the transmitting gear 21. Furthermore, a clutch 25 and a trigger drum 26 are mounted on the cam shaft 20a, and a trigger 27 is releasably engaged with the trigger drum 26. When the trigger 27 is brought into engagement with the trigger drum 26, the clutch 25 is disengaged so as not to transmit the driving force of the blade driving motor 22 to the cam 20, while when the engagement of the trigger 27 with the trigger drum 26 is released, the clutch 25 is engaged so as to transmit the driving force of the blade driving motor 22 to the cam 20. The separation sensor 45 is located in the carrier line 40 at a position downstream of the bursting portion 16a of the blade 16 by a predetermined distance.

As shown in FIG. 2, the driving motor 28 for driving the carrier rollers 8a located just upstream and downstream of the paper separating means 1 is electrically connected to a paper fixing means 30 in the control unit 29. The paper fixing means 30 generates a signal to this driving motor 28 to fix a rotor (not shown) of the driving motor 28 and thereby suppress free rotation of the carrier rollers 8a located just upstream and downstream of the paper separating means 1. The blade driving motor 22, the trigger 27 and the separation sensor 45 are also electrically connected to the control unit 29.

Figure 5:
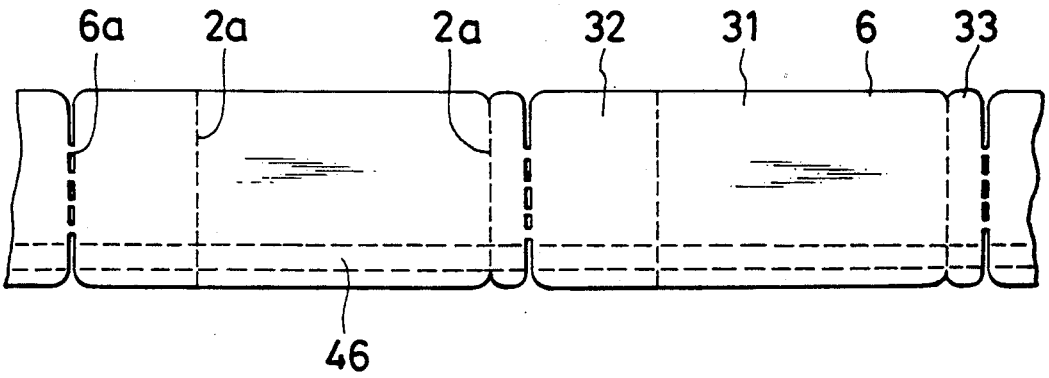
FIG. 5 is a plan view of a part of the continuous form.

The encoder 9 is also electrically connected to the control unit 29, so as to form a magnetic record on a magnetic stripe 46 formed at a side portion of the boarding card 2 as shown in FIG. 5.

The printer 10 is also electrically connected to the control unit 29, and it is constituted of a platen 10a and a thermal head 10b. The thermal head 10b is operated to contact the platen 10a through the boarding card 2 and an ink ribbon 11a contained in a ribbon cassette 11.

There are provided at a terminal region of the carrier line 40 downstream of the printer 10 a card outlet 12, a card stocker 13 and a void bin 47. After passing the printer 10, a feeding direction of the boarding card 2 is selected by a plurality of selector plates 14 so as to feed the boarding card 2 to one of the card inlet 12, the card stocker 13 and the void bin 47. Further, a manual insertion opening 15 is provided from which the boarding card 2 is inserted to be reversely fed to the encoder 9.

As shown in FIG. 5, the continuous form 6 is formed with a plurality of scores 6a, so that it may be separated along the scores 6a into a plurality of boarding cards 2. Each of the boarding cards 2 is formed with two fine scores 2a to define a card body 31 at a central portion, a boarding pass 32 at one end portion, and a stub 33 at the other end portion. Each of the scores 6a has two deep notches at the opposite ends.

In operation the continuous form 6 fed from either of the stockers 5 is carried by the carrier rollers 8a in the carrier line 40 s being guided by the guide plates 7. During the course of carrying the continuous form 6, it is separated along the scores 6a by the paper separating means 1 to form the blank boarding cards 2, which are then fed to the encoder 9 to form a desired magnetic record on the magnetic strip 46 on each boarding card 2. After passing the encoder 9, the boarding cards 2 are fed to the print, thus finally obtaining desired boarding cards 2. The magnetic record to be formed on the magnetic stripe 46 of each boarding card by the encoder 9 includes a name, seat number, destination, flight time, seat class, etc., and the print to be formed on each boarding card 2 by the printer 10 includes flight information, etc. The boarding cards 2 thus obtained are selectively fed to the card outlet 12 for issuing the cards 2, the card stocker 13 for stocking the cards 2, or the void bin 47 for retaining any void cards 2 by operating the selector plates 14. That is, the boarding cards 2 continuously fed are normally stocked in the card stocker 13. In the case of issuing only one boarding card 2, the card 2 is fed to the card outlet 12. In the case where the magnetic record or the print is erroneous, such an undesired card 2 is retained in the void bin 47. Further, in the case of a modification or change in flight information or check-in, the boarding card 2 is inserted from the manual insertion opening 15 to be fed to the encoder 9 to carry out necessary modifications or the like.

In feeding the continuous form 6 from either of the stockers 5 to the carrier line 40, a leading end of the continuous form 6 is inserted from the paper inlet 40*a* of the branch portion 40' corresponding to the selected stocker 5. As a result, the leading end of the continuous form 6 is detected by the start sensor 42, and a detection signal is generated from the start sensor 42 to the paper feed control means 44. Accordingly, a paper feed start signal is generated from the paper feed control means 44 to the paper feeding means 41, thereby operating the paper feeding means 41. That is, the paper feeding motor 41*b* is forwardly rotated, and the rotation of the motor 41*b* is transmitted through the driving belt 41*c* to the paper feeding rollers 41*a*. As a result, the continuous form 6 guide to the paper feeding rollers 41*a* is automatically fed in the forward direction. When the leading end of the continuous form 6 reaches the stop sensor 43, and is detected by the stop sensor 43, a detection signal is generated from the stop sensor 43 to the paper feed control means 44. Accordingly, a paper feed stop signal is generated from the paper feed control means 44 to the paper feeding means 41. As a result, the operation of the paper feeding means 41 is stopped to stop the forward feeding of the continuous form 6. Thus, the feeding of the continuous form 6 into the carrier line 40 can be automatically carried out to thereby easily set the continuous form 6 at the upstream end portion of the carrier line 40.

Meanwhile, reverse feeding of the continuous form 6 can be also automatically carried out by the paper feeding means 41. That is, when a paper reverse feed signal is input into the paper feed control means 44, the paper feed control means 44 controls to operate the paper feeding means 41 in such a manner that the paper feeding motor 41*b* is reversely rotated, and the rotation of the motor 41*b* is transmitted through the driving belt 41*c* to the paper feeding rollers 41*a*. Thus, the continuous form 6 is fed in the reverse direction to be automatically returned from the carrier line 40 to the stocker 5. Accordingly, it is possible to prevent that the continuous form 6 will be broken or cut at the scores 6*a* due to forced tension to be applied to the continuous form 6 upon returning the continuous form 6 to the stocker 5.

As the two stockers 5 are provided in this preferred embodiment, different kinds of the continuous form 6 may be stocked in the stockers 5, and either kind of the continuous form 6 may be selectively used as desired. On the contrary, as the paper separating means 1 is located downstream of the joining point of both the branch potions 40' of the carrier line 40, two paper separating means corresponding to the two stockers 5 are not necessary but only one paper separating means is necessary. Accordingly, complication and enlargement of the machine may be effectively prevented. Further, even when the number of the stockers 5 is more increased, the paper separating means 1 may by maintained single by merely branching the carrier line 40 in accordance with the number of the stockers 5, thus remarkably exhibiting the effect of prevention of the complication and enlargement of the machine. Even in the case where the continuous form 6 contained in both the stockers 5 are simultaneously fed to the branch portions 40' of the carrier line 40, both the continuous forms 6 are automatically stopped at the positions of the respective stop sensors 43, that is, they are always stopped before the joining point of the branch portions 40', and either of the continuous forms 6 is then selected to be fed forwardly to the position of the paper separating means 1. Thus, regardless of the number of the stockers 5, the feeding of the continuous form 6 to the paper separating means 1 can be smoothly carried out.

Thereafter, when the continuous form 6 is fed forwardly in the carrier line 40, and the leading end of the continuous form 6 is detected by the separation sensor 45, the continuous form 6 is stopped at the position of the separation sensor 45. That is, a detection signal is generated from the separation sensor 45 to the control unit 29, and the control unit 29 controls according to the detection signal to stop the driving motor 28 for driving the carrier rollers 8*a* located downstream of the separation sensor 45 and the paper feeding motor 41*b* for driving the paper feeding rollers 41*a*. As a result, the continuous form 6 is maintained still. The position of the separation sensor 45 is set in such a manner that the score 6*a* of the continuous form 6 faces the bursting portion 16*a* of the blade 16 under such a still condition of the continuous form 6. Under the condition, the blade 16 is driven by the blade driving means 17 to press the bursting portion 16*a* against the score 6*a* of the continuous form 6 and thereby separate the continuous form 6 along the score 6*a*. More specifically, when the feeding of the continuous form 6 is stopped, a paper fixing signal is output from the paper fixing means 30 in the control unit 29 to the driving motor 28 for driving the carrier rollers 8*a* located just upstream and downstream of the paper separating means 1, thereby fixing the rotor of this driving motor 28. Accordingly, free rotation of the carrier rollers 8*a* located just upstream and downstream of the paper separating means 1 is suppressed to fix the continuous form 6 retained between the carrier rollers 8*a*. Under the fixed condition, when the engagement of the trigger 27 with the trigger drum 26 is released, the clutch 25 is engaged to transmit the driving force of the blade driving motor 22 to the cam 20 and accordingly rotate the cam 20. As a result, the contact member 18 of the blade 16 is displaced downwardly by the biasing force of the spring 19, and the bursting portion 16*a* of the blade 16 is accordingly displaced downwardly to be pressed against the score 6*a* of the continuous form 6, thereby bursting the continuous form 6 along the score 6*a*.

In such a bursting operation of the continuous form 6, the opposite side edges of the bursting portion 16*a* of the blade 16 are first forced into the deep notches of the score 6*a* formed at the opposite ends thereof. As lowering the blade 16, the score 6*a* is cut from the weakest opposite ends thereof to the central portion. Accordingly, the continuous form 6 can be separated with a small force. Further, the round shape of the bursting portion 16*a* of the blade 16 contributes to the above effect since a contact resistance between the bursting portion 16*a* and the continuous form 6 can be reduced owing to the roundness of the bursting portion 16*a*.

In the event that the score 6*a* is not positioned just below the bursting portion 16*a* of the blade 16, the bursting portion 16*a* will come into contact with a portion of the continuous form 6 other than the score 6*a*. In this case, however, there is no possibility that the continuous form 6 will be burst at the portion other than the score 6*a* because the bursting portion 16*a* is not a sharp cutter. Furthermore, as mentioned above, the contact resistance between the bursting portion 16*a* and the continuous form 6 is small owing to the roundness of the bursting portion 16*a*, and the continuous form 6 is fixedly retained by the carrier rollers 8*a* located just upstream and downstream of the blade 16. Therefore, even when the score 6*a* is not positioned just below the bursting portion 16*a*, the continuous form 6 is reliably separated at the score 6*a* which is the weakest portion of the continuous form 6, thus preventing a problem such that the continuous form 6 will be dragged by the blade 16 to cause undesired bursting.

Figure 6:
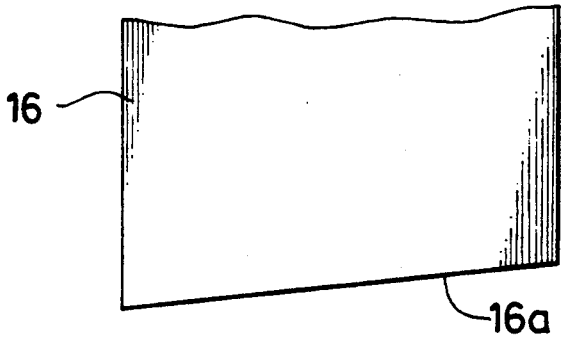
FIG. 6 is a view similar to FIG. 4, showing a modification of the bursting portion of the blade.

Referring next to FIG. 6 which shows a modification of the blade 16, the bursting portion 16*a* of the blade 16 is so configured as to be inclined downwardly from one side edge to the other side edge as viewed in front elevation. With this construction, the other side edge of the bursting portion 16*a* is first forced into the one end of the score 6*a*, and as lowering the blade 16, the score 6*a* is cut from the one end to the other end. Thus, also in this modification, the score 6*a* can be cut from the weakest one end thereof by the bursting portion 16*a*, thereby reliably separating the continuous form 6 with a small force.

There will now be described a second preferred embodiment of the present invention. In the following description, the same parts as those mentioned in the first preferred embodiment will be designated by the same reference numerals, and the explanation thereof will be omitted. In the second preferred embodiment, upon separating the continuous form 6, the paper fixing means 30 generates a rotation signal to the driving motor 28 for driving the carrier rollers 8*a* located just upstream and downstream of the paper separating means 1. That is, when the paper fixing means 30 generates the rotation signal to this driving motor 28, the driving motor 28 applies a torque to the carrier rollers 8*a* in opposite directions such that a tension is applied to the continuous form maintained still between the carrier rollers 8*a*.

With this construction, a strong tension due to the torque of the carrier rollers 8*a* located just upstream and downstream off the paper separating means 1 is applied to the continuous form 6 maintained still between the carrier rollers 8*a* upon contacting of the blade 16 with the continuous form 6. Therefore, the dragging of the continuous form 6 by the blade 16 in its forcing direction can be prevented more reliably.

What is claimed is:

1. A ticket issuing machine comprising: a carrier line for guiding a continuous form in a predetermined path;

at least one stocker for containing said continuous form, said continuous form being inserted into an inlet of said carrier line;

paper carrier means for carrying said continuous form in said carrier line;

paper separating means provided in said carrier line for separating said continuous form, said paper separating means comprising a blade retained so as to be movable toward and away from a score formed in said continuous form, said blade having a rounded bursting portion adapted to face said score, and blade driving means for driving said blade so as to bring said blade into abutment against said score for separation of said continuous form at said score;

paper feeding means provided in the vicinity of said inlet off said carrier line for feeding said continuous form in forward and reverse directions;

a start sensor provided upstream of said paper feeding means in said carrier line for detecting whether or not said continuous form is present in said carrier line;

a stop sensor provided downstream of said paper feeding means in said carrier line for detecting whether or not said continuous form is present in said carrier line, said stop sensor also being located upstream of said paper separating means; and paper feed control means for generating a paper feed start signal to said paper feeding means according to a detection signal output from said start sensor and also generating a paper feed stop signal to said paper feeding means according to a detection signal output from said stop sensor, thus effecting automatic forward feeding of said continuous form up to said stop sensor.

2. The ticket issuing machine according to claim 1, wherein said paper feed control means further generates a paper reverse feed signal to control said paper feeding means to feed said continuous form in the reverse direction, thereby said continuous form being returned to said stocker.

3. The ticket issuing machine according to claim 1, further comprising:

printing means provided in said carrier line for printing data on said continuous form.

4. The ticket issuing machine according to claim 1, further comprising:

recording means provided in said carrier line for recording data on said continuous form.

5. The ticket issuing machine according to claim 4, further comprising:

printing means provided in said carrier line for printing data on said continuous form.

* * * * *